US005950278A

United States Patent [19]

Collins

[11] Patent Number: 5,950,278

[45] Date of Patent: Sep. 14, 1999

[54] DRAPERY SUPPORT AND DRAWING STRUCTURE

[76] Inventor: Thomas L. Collins, 4715 Annaway Dr., Edina, Minn. 55436

[21] Appl. No.: 09/014,453

[22] Filed: Jan. 28, 1998

[51] Int. Cl.[6] ..... E05D 15/00; A47H 13/00

[52] U.S. Cl. ..... 16/87.2; 16/87.4 R; 160/330

[58] Field of Search ..... 16/87.2, 87.4 R, 16/94 R, 96 R, 96 D; 160/330

[56] References Cited

U.S. PATENT DOCUMENTS

| | | | |
|---|---|---|---|
| 17,967 | 8/1857 | Graves . | |
| 367,545 | 8/1887 | Pfeifer . | |
| 555,031 | 2/1896 | Aguero . | |
| 572,249 | 12/1896 | Eckert . | |
| 684,113 | 10/1901 | Shaddle . | |
| 723,203 | 3/1903 | Kinsell . | |
| 760,287 | 5/1904 | Weigel . | |
| 780,166 | 1/1905 | Foster . | |
| 819,399 | 5/1906 | Barb . | |
| 838,867 | 12/1906 | Lalus . | |
| 840,282 | 1/1907 | Adamowicz . | |
| 1,017,754 | 2/1912 | Hart . | |
| 1,990,313 | 2/1935 | Sussman . | |
| 2,385,608 | 9/1945 | Castagna | 6/87.2 |
| 2,518,301 | 8/1950 | French et al. . | |
| 2,524,426 | 10/1950 | Comerford et al. . | |
| 2,609,873 | 9/1952 | Falkenberg . | |
| 2,623,215 | 12/1952 | Newman . | |
| 3,139,647 | 7/1964 | Cialella | 16/87.2 |
| 3,199,142 | 8/1965 | Salzzmann et al. | 16/87.2 |
| 3,286,299 | 11/1966 | Golden | 16/87.2 |
| 3,329,992 | 7/1967 | Smith et al. | 16/87.4 R |
| 3,478,805 | 11/1969 | Haggard . | |
| 3,497,905 | 3/1970 | Pflum | 16/87.4 R |
| 3,543,328 | 12/1970 | Egea et al. | 16/87.2 |
| 3,609,795 | 10/1971 | Znamirowski et al. | 16/87.2 |
| 3,703,740 | 11/1972 | Mann et al. | 16/87.2 |
| 3,997,944 | 12/1976 | Philips | 16/87.4 R |
| 4,231,141 | 11/1980 | Derrick et al. . | |
| 5,209,029 | 5/1993 | Foerst . | |
| 5,282,292 | 2/1994 | Levy | 16/87.2 |
| 5,551,500 | 9/1996 | Allsopp . | |

*Primary Examiner*—Chuck Y. Mah

*Attorney, Agent, or Firm*—Palmatier, Sjoquist, Voigt & Christensen, P.A.

[57] ABSTRACT

A drapery support and drawing structure having drapery guides, a rod mechanism and a drapery panel. Each of the drapery guides incorporate a plate and a rod engagement mechanism. The plates are inserted into uniquely spaced pockets on the back side of the drapery panel. The rod engagement mechanism slidably engages the rod mechanism. The rod mechanism incorporates an inner extension that extends and retracts within an outer extension; the outer extension alone may be supported by mounting brackets. When the inner extension is fully extended a flat panel drapery results. However, when the inner extension is partially or fully retracted the drapery guides are proximate each other and evenly spaced pleats are formed. At all times the rod mechanism is hidden behind the drapery panel. A drawing wand may be utilized to extend and retract the inner extension.

19 Claims, 4 Drawing Sheets

DRAPERY SUPPORT AND DRAWING STRUCTURE

This invention relates to an apparatus and support rod for draperies and including the drapery construction to accommodate the apparatus and support rod.

BACKGROUND OF THE INVENTION

Draperies are costly items for those decorating a home. The high cost of draperies is a result of the fabric expense and the time-intensive and complex sewing that is often involved in their making. For instance, most draperies contain pleats. Each pleat is formed by the careful gathering and folding of fabric so that it can be carefully tacked in place to create the desired draping effect. Depending on the width of a drapery panel, anywhere from five to twenty-five or more pleats may be necessary. Even for those skilled in the art of drapery making, the task of creating and completing a single pleat is an intensive project in and of itself.

Hanging draperies usually involves the use of hooks, each having a sharp-edged pin. The sharp-edged pin is inserted through the pleat while the hook is generally connected to a traverse rod. This use of sharp-edged pins provides a means for fastening drapery to the drapery rod where the pleat is necessary to hide the edge pin. The hook with its sharp-edged pin can be a danger to those who work with them, no doubt many drapery artisans have suffered a punctured finger or two. In addition, the pins as penetrating the fabric may cause tears, or partially extend through the fabric posing a danger to persons. The hook may also be deemed a danger to children. An unwary child who finds such a hook on the floor may be injured by the pin and a small child may even be able to swallow such a pin. Also, the pins as known may be either unintentionally or intentionally pulled through the fabric exposing a sharp point or edge to an individual.

Furthermore, many draperies make use of a traverse rod for hanging. The traverse rod is a large bulky rod that must span the whole width of a window that is to be covered by the drapery. The traverse rod uses an endless cord to move the hooks and the draperies across the window. The cord is subject to wear and it must maintain a certain tension in order for the rod to work properly.

Based on the above, there is a need for a drapery support and drawing structure that is able to create pleats yet eliminate the need for time-consuming, complexly-sewn pleats, eliminating the need for small hooks containing sharp-edged pins and eliminating the need of a bulky traverse rod.

SUMMARY OF THE INVENTION

The drapery support and drawing structure is capable of creating pleated draperies without the need for time-consuming, complexly-sewn pleats. The drapery support and drawing structure includes a plurality of drapery guides, an extension rod and a single drapery panel. Each of the drapery guides is of a predetermined width and incorporates a back plate and a rod engagement mechanism. The extension rod has a channel that is slidably engaged by the rod engagement mechanism. The single drapery panel is of a predetermined width and incorporates a plurality of pockets. The pockets may be spaced at equal or unequal intervals along the top of the drapery or on the end to provide a desired effect. The pockets are adapted to accept the back plate of the drapery guide. The drapery panel naturally forms pleats when the drapery guides are moved proximate to each other.

It is an object and advantage of the present invention to provide a pleated drapery that does not require the time-consuming process of creating complexly-sewn pleats and the additional material necessary to create the sewn-in pleat.

It is another object and advantage of the present invention to virtually eliminate the need for drapery hooks that are usually necessary to hang pleated draperies. These hooks can be dangerous to adults and especially children.

It is still another object and advantage of the present invention to eliminate the need for bulky and often unattractive traverse rod systems or small single straight rod systems as presently available. Rather the present invention offers an extension rod that may be hidden behind the drapery panel. It should be noted that the rod is a possible option to the present invention and is not essential to the disclosed drapery system.

It is still another object and advantage of the present invention to eliminate the need for a drapery drawing cord. Such a cord is subject to wear and must be set at a proper tension. These drapery cords break easily necessitating time-consuming efforts to replace. Rather the present invention offers a drawing wand that is hidden behind the drapery panel and involves no special installation techniques.

Yet another object and advantage of the present invention is to provide a user with a design that may be easily altered to change the width of the resulting pleats by changing the predetermined width of the drapery guide, pockets and spacing between pockets to modify the look of the pleated panel when closed.

It is still another object and advantage of the present invention to minimize the fabric requirements needed to cover a window while providing a pleated panel look when the drapery panel is open.

It is still another object and advantage of the present invention to provide a drapery support system which is easier to maintain, offers improved economy with respect to fabric demands, and facilitates the trimming of fabric and the construction of drapes.

It is still another object and advantage of the present invention to position the pleats of a drapery panel forward of the drapery rod allowing for a reduced mounting distance from a window.

It is still another object and advantage of the present invention to provide for the fixed control of a fabric header of a drapery panel.

It is still another object and advantage of the present invention to cantilever the plane of the drapery panel forwardly with respect to the center line of the drapery rod for positioning of the drapery panel vertically establishing a continuous fabric drapery panel plane.

DETAILED DESCRIPTION OF THE PREFERRED EMBODIMENT

The drapery support and drawing structure 10 generally comprises drapery guides 20, an extension rod 40 and a drapery panel 66.

Figure 1:
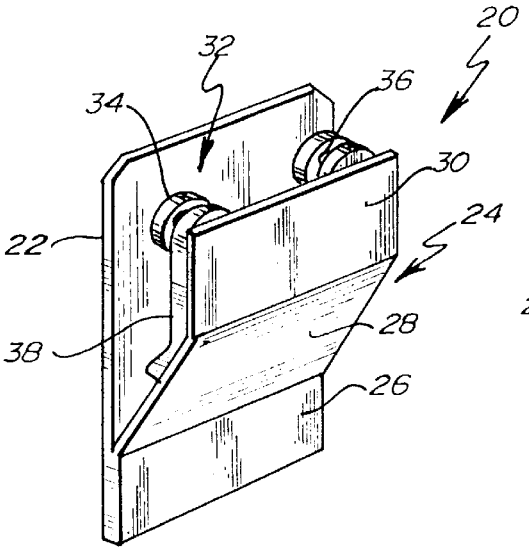
FIG. 1 is a perspective view of the drapery guide of the present invention.
Figure 2:
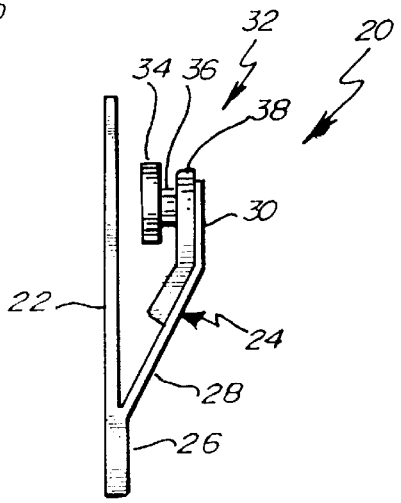
FIG. 2 is a side view of the drapery guide.

A single drapery guide 20 is shown in FIGS. 1 and 2. The drapery guide 20 is generally a singular piece made of a composite plastic and is of a predetermined width. The drapery guide 20 incorporates a front plate 22, a back plate 24, and a rod engagement mechanism 32. The front plate 22 is desirably rectangular in shape, rigid and maintains a vertical position. The back plate 24 may include essentially three sections, a lower vertical portion 26, a middle angled portion 28 and a top vertical portion 30. The lower vertical portion 26 may be affixed to the front plate 22 while the middle angled portion 28 may extend outward and upward from the lower vertical portion 26. The middle angled portion 28 may be angled approximately 30° off of the vertical front plate (or 60° off horizontal). Alternatively, the lower vertical portion 26, middle angled portion 28, and top vertical portion 30 may be substantially one piece and angled sufficiently to engage a rod system 40. The above-identified angle has been found to work well, although other angles may be used. Extending vertically upward from the angled middle portion 28 is the top vertical portion 30. Note that in this embodiment the total length or height of the back plate 24 is just slightly shorter than the front plate 22.

Figure 8:
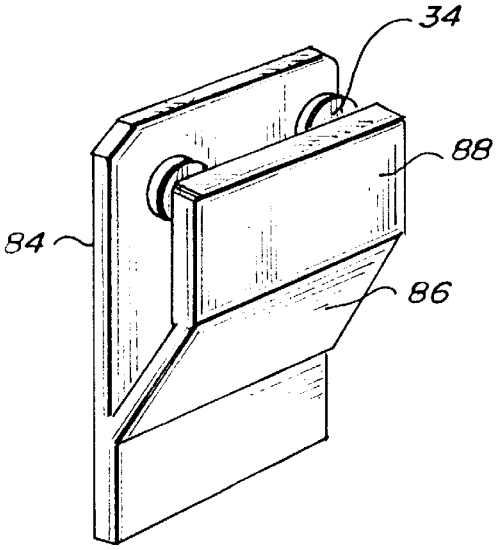
FIG. 8 is an alternative perspective view of the drapery guide of the present invention.
Figure 9:
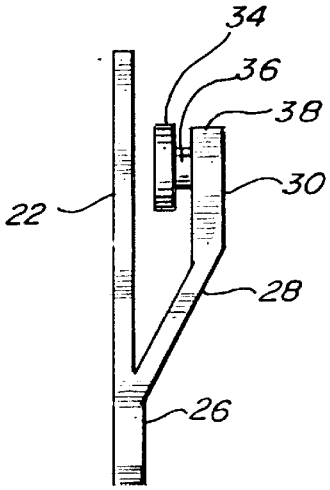
FIG. 9 is a side view of the drapery guide of FIG. 8.

The drapery guide's rod engagement mechanism 32 may be comprised of three components, a forward tab 34, a channel guide 36 and a rear tab 38. The forward tab 34 is preferably of a thin, disk shape. Extending outward and back from the forward tab 34 is the channel guide 36 which is approximately half the diameter of the forward tab 34. The channel guide 36 itself extends back to the rear tab 38 which may be an elongated rectangular shape that is flush with and conforms to the angularity of the top vertical portion 30 and middle angled portion 28. In an alternative embodiment as depicted in FIGS. 8 and 9, the rear tab 38 is integral to the top vertical portion 30. In this embodiment, the channel guide 36 extends directly outwardly from the top vertical portion 30 which may preferably be enlarged in width dimension for structural considerations.

The drapery guide 20 of FIGS. 1 and 2 may contain either one long or two rod engagement mechanisms 32. A larger number of rod mechanisms 32 may be necessary depending on the desired width of the drapery guide 20. The diameter of forward tab 34 is selected to be larger than the width of the central slot 48 but smaller than the channel 50 of the rod mechanism 32. The diameter of the channel guide 36 may be selected to be slightly smaller than the width of the central slot 48. The rod engagement mechanism 32 may be constructed from individual plastic piece parts and thereafter adhered to the inside of the back plate 24 using an adhesive material. Alternatively, the drapery guide 20 may be formed from a single composite molded part having the construction features illustrated in FIGS. 1 and 2.

Figure 3:
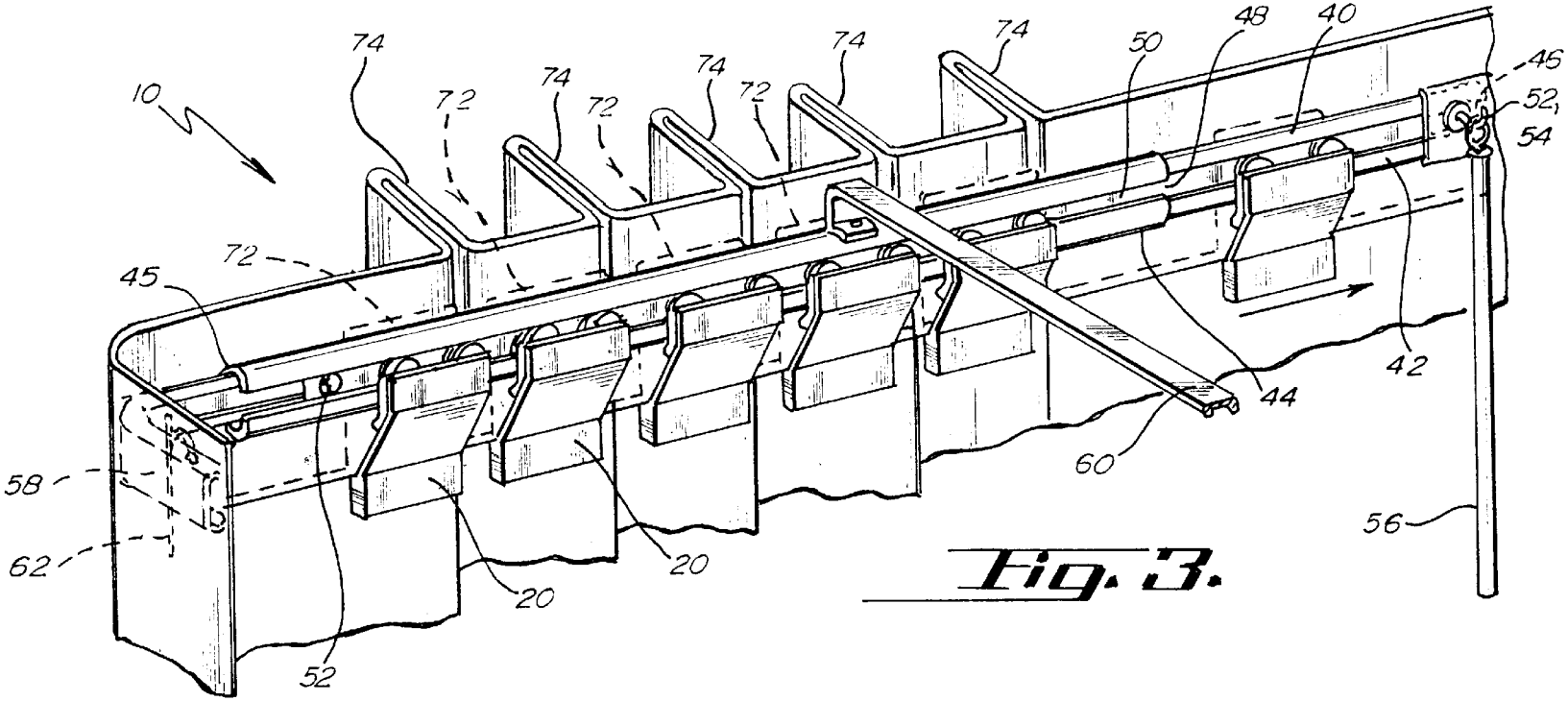
FIG. 3 is a rear perspective view of the drapery support an drawing structure.
Figure 4:
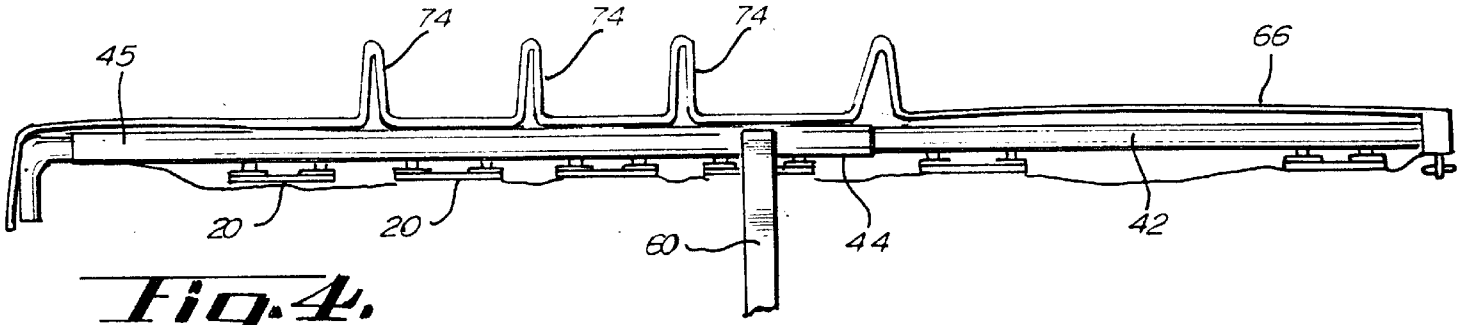
FIG. 4 is a top view of the drapery support and drawing structure.

The extension rod 40, shown specifically in FIGS. 3 and 4, incorporates an inner extension 42 and an outer extension 44. Both the inner 42 and outer 44 extensions are elongate in shape, the inner extension 42 is sized to fit easily but not loosely within the outer extension 44 so that it may be slid in and out of the outer extension 42 in a telescoping manner. The inner and outer extensions 42, 44 each have a central slot 48 that with the interior of the inner and outer extensions 42, 44 forms a channel 50. The forward tab 34 of the rod engagement mechanism 32 is sized to fit and slide easily within the channel 50 while the channel guide 36 is sized to fit and slide easily along the central slot 48. The extension rod 40 has a bracket mounting end 45 and an open end 46 that allows for the drapery guide's rod engagement mechanism 32 to be slid into the channel 50 and central slot 48. Stops 52 may then be placed at both ends of the extension rod 40 to ensure that the drapery guides 20 do not slide off of the rod 40.

The stop 52 located at the open end 46 of the inner extension 42 may also be equipped with a hook 54 such that a drawing wand 56 may be attached to extend and retract the inner extension 42. Alternatively, the drawing wand 56 may be attached to a standard clip which in turn is engaged to the extension rod 40 in a straight rod application. The extension rod 40 is ideally mounted to a surface with at least two mounting brackets. The first mounting bracket is an elbow-type, end mounting bracket 58 that is attached to the bracket mounting end 45 of the extension rod 40. The second mounting bracket, is a hook-type mounting bracket 60. The mounting bracket 60 should be placed along the length of the outer extension 44; the bracket 60 then extends outward from the surface and wraps about the extension rod 40 holding it in position. Noticeably, the bracket 60 does not interfere with the movement of the drapery guides 20 and does not interfere with the movement of the drapery panel 66, discussed below. Depending on the width of the outer extension 44, more than one mounting bracket 60 may be necessary.

Figure 5:
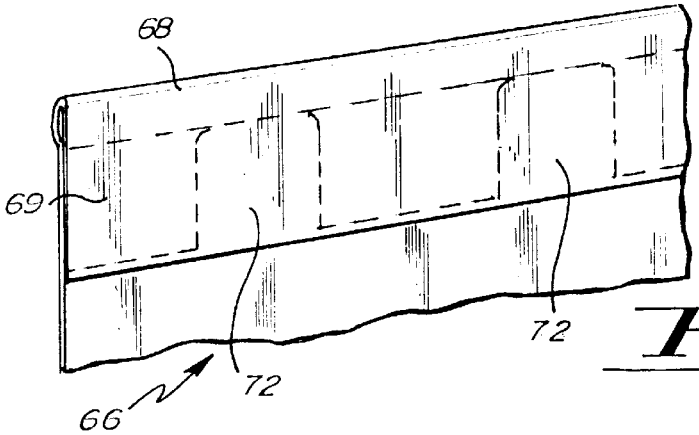
FIG. 5 is a rear perspective of the drapery panel of the present invention.
Figure 5:
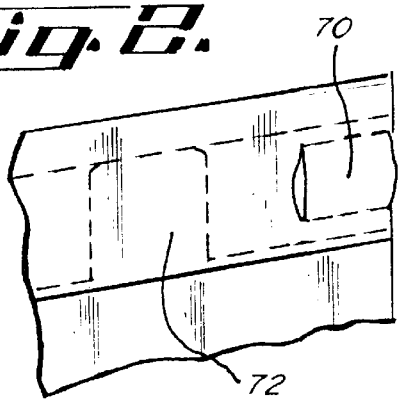
Figure 6:
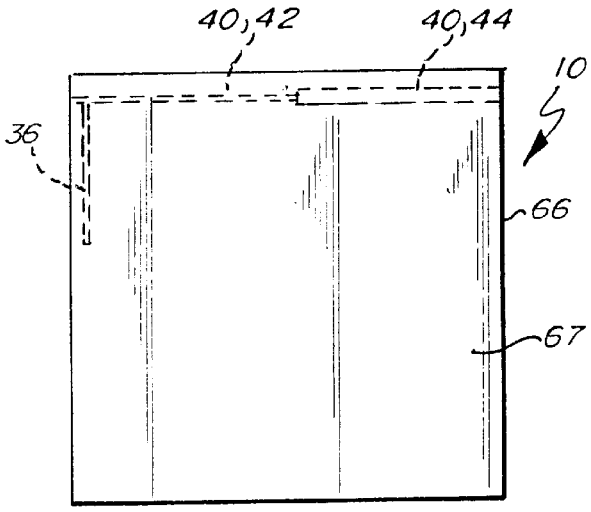
FIG. 6 is a front view of the drapery support and drawing structure in its fully expanded position in front of a window.
Figure 7:
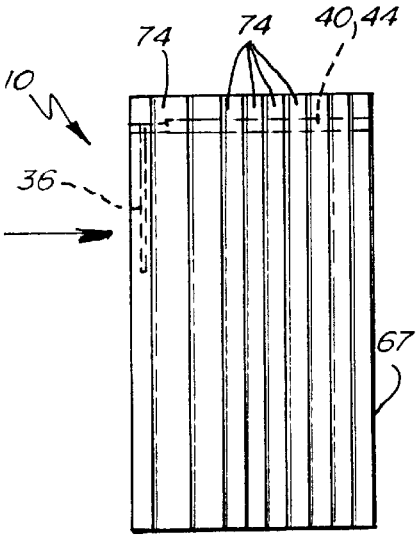
FIG. 7 is front view of the drapery support and drawing structure in its fully retracted position in front of a window.

The drapery panel 66, shown in FIGS. 5–7, incorporates a front panel 67, a top flap 68 and a backing panel 69. The front panel 67 faces out to a room as shown in FIGS. 6 and 7. The top flap 68 is a continuation of the front panel 67 and is folded over to the backside of the panel 67. Placed behind the top flap 68 is a strip of webbing creating a backing panel 69. Webbing is chosen because it is a stiffer type of fabric that will provide additional support to the drapery panel 66; however, other types of materials may be used as well. The top of the backing panel 69 is sewn to the front panel 67 and the top flap 68 along the whole width of the panel 67. The bottom of the backing panel 69 is then sewn to the front panel 67 alone leaving the unsewn portion of the top flap 68 essentially loose in front of the backing panel 69. This loose portion of the top flap 68 is then sewn to the backing panel 69 to create pockets 72 along the full expanse of the drapery panel 66. The width of each of the pockets 72 is approximately equivalent to the width of one drapery guide 20. The pockets 72 are preferably spaced such that a distance equal to approximately twice the desired depth of the pleat exists between each pocket 72. A side pocket or side slit 70 is provided in the top flap 68 such that the open end 46 of the inner extension 42 of the extension rod 40 may be inserted between the top flap 68 and backing panel 69.

The assembly of the drapery support and drawing structure 10 first requires that the structure be mounted to a wall surface or window trim. The end mounting bracket 58 and the mounting bracket 60 should be mounted to a rigid surface so that the outer extension 44 is securely held in spaced position from the wall surface and adjacent to the window opening for which the drapery is intended. Next, a plurality of drapery guides 20 are slidably inserted along the central slot 48 and channel 50 through the open end 46 of the extension rod 40; a sufficient or desired number of drapery guides 20 should be installed to be equal to the number of pockets 72 formed in the drapery which is to be hung. Next, the drapery is connected to the drapery guides 20 by inserting a guide 20 into a pocket 72, and the open end of the extension rod 40 should be inserted through the side slit 70 in the drapery. A stop 52 should be placed at the open end 46 of the extension rod 40, which should be constructed to accommodate the connection of a drawing wand 56.

In operation, the drawing wand 56 is used to extend and retract the inner extension 42 from the outer extension 44. When the inner extension 42 is fully extended the drapery panel 66 appears as a relatively flat drapery, see FIG. 6. However, when the inner extension 42 is partially or fully retracted within the outer extension 44 the drapery panel becomes self-pleating and creates a plurality of pleats 74, see FIG. 7. As shown in FIGS. 3 and 4, when the drapery guides 20 and the pockets 72 in which they reside are drawn next to each other, the expanse of fabric between the pockets (which is, once again, approximately equal to approximately twice the desired depth of the pleat) folds over itself to create a pleat 74. When the drapery panel 66 is fully retracted, as shown in FIG. 7, the drapery panel 66 is nicely and completely pleated. Further, there is no ugly traverse rod or drawing cord marring the view. Rather all of the elements such as the extension rod 40 and the drawing wand 56 are hidden behind the drapery panel 66.

Because this is essentially a cantilevered design, the inner extension 42 extends out from the outer extension 44 without any support except that provided by the outer extension 44 itself, it is important to pay attention to the full extended length of the rod 40, the weight of the rod 40 and the weight of the drapery panel 66. Too much weight or too much length on a fully extended inner extension might result in collapse of the drapery support and drawing structure 10.

An alternative drapery guide 20 is depicted in FIGS. 8 and 9. This type of drapery guide 20 eliminates the provision of the rear tab 38 through the incorporation of a thicker, sturdier top vertical portion 30. In this embodiment, the channel guide 36 extends directly from the interior of the top vertical portion 30 toward the front plate 22. In this embodiment, the drapery guide 20 may be formed of one-piece molded construction where the lower vertical portion 26 is integral to the middle angled portion 28 and top vertical portion 30. In addition, it should be noted that the extension and relationship between the lower vertical portion 26 and the top vertical portion 30 may be straight as desired by an individual.

Figure 10:
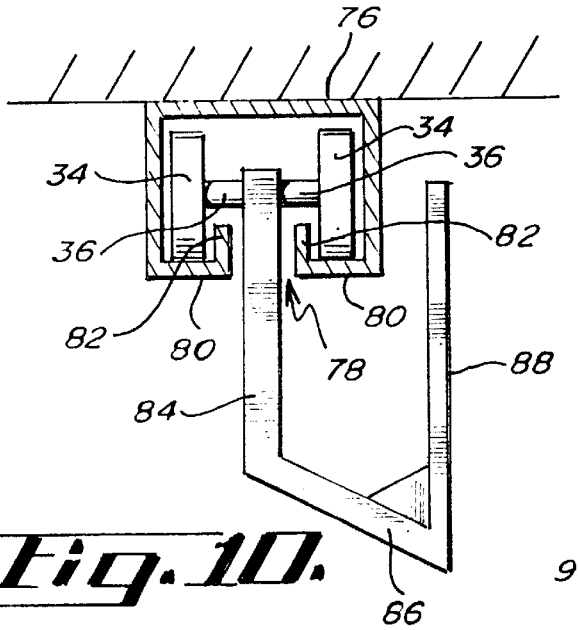
FIG. 10 is a detailed partial cross-section side view of an alternative drapery guide adapted to engage a ceiling mount.
Figure 11:
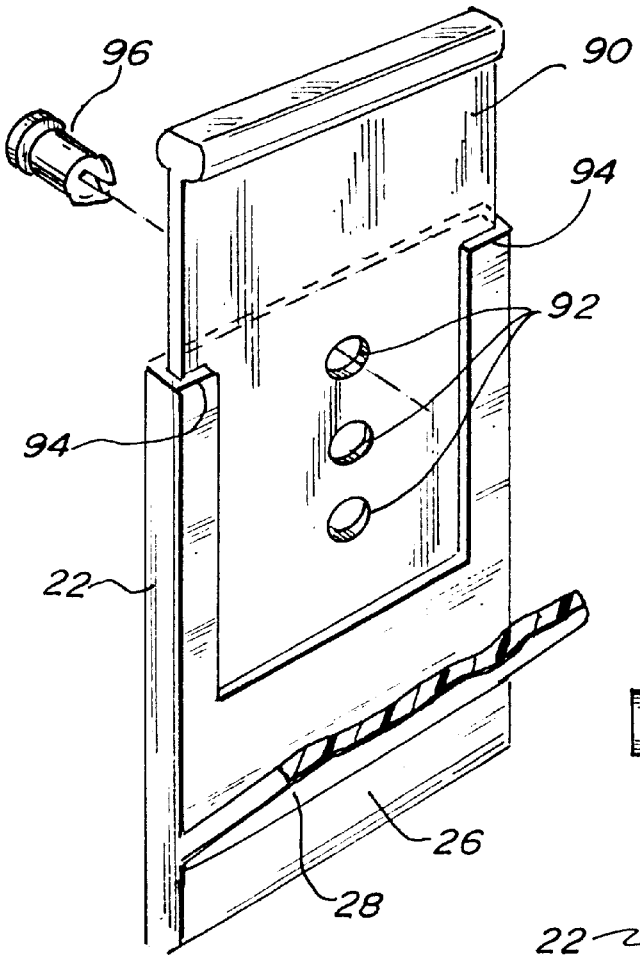
FIG. 11 is an alternative detailed partial cross-section side view of a drapery guide adapted to engage a ceiling mount.
Figure 12:
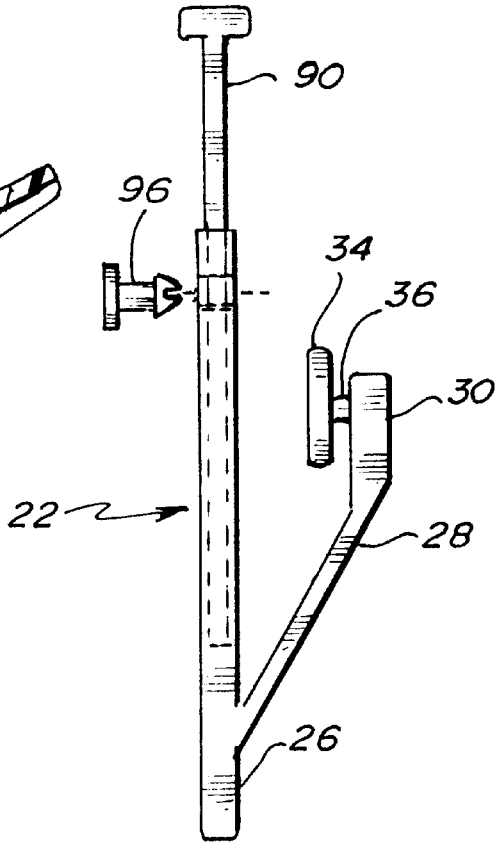
FIG. 12 is an exploded-detailed view of the drapery guide of FIG. 1.

The rod system utilized to support the drapery support and drawing structure 10 may vary considerably at the discretion of an individual. The rod support system may include telescoping extension rods 40 and inner extensions 42 or may be formed of one preferably long, straight rod system, and the options available to the rod system may be varied considerably at the discretion of an individual. As depicted in FIGS. 10–12, the drapery support and drawing structure 10 may be adapted for use with a ceiling mounting bracket 76.

In this embodiment, the ceiling mounting bracket 76 preferably includes a centrally-positioned receiving channel 78 which defines a pair of support ledges 80 disposed on each side of the receiving channel 78. Extending upwardly from each support ledge 80 is preferably a retainer lip 82 which is adapted to position and hold a pair of forward tabs 32 within the receiving channel 78.

In this embodiment, the drapery guide 20 preferably includes a vertical plate 84, an extension portion 86, and a support plate 88. The support plate 88 is preferably adapted for insertion into one of the plurality of pockets 72 for support of the drapery panel 66. A plurality of channel guides 36 preferably extend outwardly from the top of the vertical plate 84 in oppositely divergent pairs. At the end of each channel guide 36 is preferably located a forward tab 34 which may be rigidly affixed to each channel guide 36 or rotatably attached thereto at the discretion of an individual. It should be noted that the forward tabs 34 in this embodiment may incorporate ball bearings or bearing means to assist in the positioning of the drapery panel 66 in a desired location relative to the ceiling mount 76 and/or a window.

As seen in FIGS. 11 and 12, the front plate 22 may also include an extension plate 90 which may further include a plurality of positioners 92. In this embodiment, the front plate 22 preferably includes a pair of positioning lips 94 which define a pocket for the extension plate 90. The front plate 22 may also include an affixation tab 96 which is preferably adapted to engage one of the positioners 92 for the provision of adjustable vertical positioning of the extension plate 90, the front plate 22, and the drapery panel 66 relative to the extension rod 40. It should be noted that any other mechanism may be incorporated into the front plate 22, the vertical plate 84, or the support plate 88, as desired by an individual to provide for vertical adjustment of the drapery panel 66 relative to the extension rod 40 or ceiling mount 76. It should also be noted that the vertical plate 84 may also include the features of the extension plate 90, positioners 92, positioning lips 94, and/or affixation tab 96 at the preference of an individual.

Figure 13:
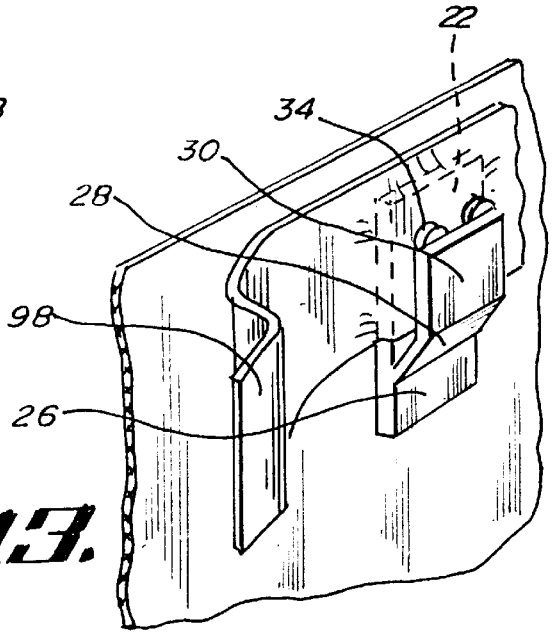
FIG. 13 is an alternative detailed view of a drapery guide and tape.

As seen in FIG. 13, in an alternative embodiment, the drapery guides 20 may be securely attached to the backing panel 69 through the use of a substantially rigid and sturdy tape 98 which preferably is of sufficient strength to not separate from the backing panel 69 during support of a drapery panel 66. Alternatively, the tape 98 may include a plurality of regularly-spaced pockets 72 adapted for receiving and releasable engagement of a drapery guide 20 at the preference of an individual. In this embodiment, the tape 98 and/or drapery guides 20 may be secured to the backing panel 69 during construction of the drapes. It should be noted that the interaction and operation between the forward tabs 34 and the central slot 48 and channel 50 is not affected in this embodiment. During use, the cantilever design of the drapery guides 20 provides rigid control of the header of the drapery panel 66. The straight, substantially vertical off-center positioning and line of the front plates 22 and vertical plate 84 for support of the drapery panel 66 facilitates the formation of a pleat 74 for extension from the top flap 68 downwardly to the bottom of the front panel 67 over the entire length of the drape. The drapery hanging devices as known, due to the weight of the drapery, create an angle between the hangers and the rod mechanism which in turn causes the pleat 74 to disappear approximately 4–8 inches down from the top flap 68. This drawback occurs because the drapery hooks as known pivot at the connection point with the hanger causing the header of the drapery panel 66 (the section below the bottom of the hook) to cant forwardly slightly due to the pull of the drapery from its own weight as the remaining panel hangs down from the hook attached to the rod at its center line. This cant causes any natural pleating generated by the moving hooks to break and cease a portion of the way down from the top of the front face 67 prohibiting the pleat 74 from extending downwardly the entire length of the front face 67 of the drapery panel 66.

The design of the drapery guide 20 cantilevers the drapery panel 66 off the center line of the extension rod 40 or ceiling mount 76, which in turn, controls, supports and allows the header of the drapery panel 66 to be positioned in the same vertical plane as the drapery panel 66. This vertical aligned positioning, in conjunction with the drapery guides 20, reinforces the pleating action when the drapery guides 20 are moved into a position proximate to each other. The pleating of the drapery panels 66 is then facilitated where the pleat 74 extends downwardly the entire length of the front face 67 of the drapery panel 66.

The drapery guides 20 of the drapery support and drawing structure 10 also position the header of the drapery panel 66 in a substantially upright position for improvement of the stability and control of the drapery panel 66 during the formation of pleats 74 when exposing a window, or during the elimination of pleats 74 when covering a window. It should also be noted that the drapery guides 20 may also be used in conjunction with straight or telescoping rod or glide systems without affecting the essential features, functions, and/or attributes described herein. It should also be noted that the rod support or glide system may be formed in a plurality of aligned segments or pieces without affecting the essential functions, features, and/or attributes described herein. Further, it should be noted that the rod support or glide system may be of a standard type, or include a right or lefthanded offset with accompanying drawing wand 56 at the discretion of an individual.

Further, it should be noted that this design is easily altered for various pleat widths. To change pleat width one need only change the width of the drapery guides 20 and adjust the width of the pockets 72 and the spacing between pockets 72 accordingly.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed is:

1. A drapery support and drawing structure that is capable of creating pleated draperies without sewn pleats, comprising:

(a) a plurality of drapery guides, said plurality of drapery guides each having a an elongate front plate and a rod engagement mechanism;

(b) a rod, said rod having a central slot, said rod engagement mechanism adapted to slidably engage said central slot; and (c) a drapery panel, said drapery panel having a plurality of pockets, each of said pockets adapted to accept one of said front plates of said plurality of drapery guides, each of said pockets located at regular spaced intervals along said drapery panel, said drapery panel adapted to form pleats when said plurality of drapery guides are moved proximate each other each of said plurality of drapery guides further comprising a back plate, said back plate extending angularly outward from said front plate and said rod engagement mechanism extending from said back plate.

2. The drapery support and drawing structure of claim 1, said rod engagement mechanism further comprising a forward tab connected to a channel guide, said channel guide connected to a rear tab, said rear tab connected to said back plate.

3. The drapery support and drawing structure of claim 2, said rod comprising an open end, said forward tab removably insertable through said open end into said central slot, said channel guide slidably positioned within said central slot, said rear tab attached to said channel guide and positioned proximate and exterior to said central slot.

4. The drapery support and drawing structure of claim 1, said rod comprising an outer extension and an inner extension slidably engaged to said outer extension.

5. The drapery support and drawing structure of claim 4, further comprising a mounting bracket attached to said outer extension.

6. The drapery support and drawing structure of claim 1, wherein said front plate is cantilevered from said rod engagement mechanism for positioning of said drapery panel and said front plate in a substantially vertical plane.

7. The drapery support and drawing structure of claim 1, said drapery panel further comprising a tape adapted for engagement to said plurality of drapery guides.

8. A drapery support and drawing structure that is capable of creating pleated draperies without the need for sewn pleats, comprising:

(a) a plurality of drapery guides, said plurality of drapery guides each having a back plate, an elongate front plate and a rod engagement mechanism, said back plate extending outwardly from said front plate, said rod engagement mechanism extending from said back plate;

(b) a rod, said rod having a central slot, said rod engagement mechanism adapted to slidably engage said central slot; and (c) a drapery panel, said drapery panel having a plurality of pockets, each of said pockets adapted to accept one of said front plates of said plurality of drapery guides, each of said pockets regularly spaced along said drapery panel, said drapery panel adapted to form pleats when said plurality of drapery guides are proximate each other.

9. The drapery support and drawing structure of claim 8, said rod engagement mechanism comprising a forward tab, connected to a channel guide, said channel guide connected to said back plate.

10. The drapery support and drawing structure of claim 9, said rod further comprising an open end, said forward tab removably insertable through said open end into said central slot, said channel guide slidably positioned within said central slot.

11. The drapery support and drawing structure of claim 8 said rod comprising an outer extension and an inner extension slidably engaged to said outer extension.

12. The drapery support and drawing structure of claim 11, further comprising a mounting bracket attached to said outer extension.

13. The drapery support and drawing structure of claim 11, further comprising a drawing wand engaged to said inner extension, said drawing wand adapted to slidably extend and retract said inner extension from said outer extension.

14. The drapery support and drawing structure of claim 8, further comprising a drawing wand engaged to one of said drapery guides.

15. A drapery support and drawing structure capable of creating pleated draperies without sewn pleats, comprising:

(a) a plurality of drapery guides, said drapery guides each having a back plate, an elongate front plate and a rod engagement mechanism, said back plate extending angularly outward from said front plate, said rod engagement mechanism extending from said back plate, said rod engagement mechanism having a forward tab and a channel guide;

(b) a rod, said rod having an open end, a central slot, and a stop, said forward tab removably insertable through said open end into said central slot, said channel guide slidably positioned within said central slot, said stop removably attached across said open end, said stop adapted to prevent said forward tab from disengaging said rod;

(c) a drapery panel, said drapery panel having a top flap, a backing panel, and a side slit, said top flap and said backing panel attached so as to create a plurality of spaced-apart pockets across said drapery panel, each of said pockets adapted to removably receive said front plate of said drapery guide, said side slit adapted to receive said open end of said rod, said drapery panel adapted to form pleats when said plurality of drapery guides are proximate each other; and (d) a drawing wand, said drawing wand attachable to said rod, said drawing wand adapted to extend and retract said rod.

16. The drapery support and drawing structure of claim 15, further comprising an outer extension and an inner extension slidably engaged to said outer extension.

17. The drapery support and drawing structure of claim 16, wherein said drawing wand is attached to said inner extension.

18. The drapery support and drawing structure of claim 16, said rod comprising a bracket mounting end.

19. The drapery support and drawing structure of claim 18, further comprising a central mounting bracket attached to said outer extension and an affixation bracket attached to said bracket mounting end.

* * * * *